US008803439B2

(12) United States Patent
Stamm et al.

(10) Patent No.: US 8,803,439 B2
(45) Date of Patent: Aug. 12, 2014

(54) PRIMARY-SIDE REGULATION OF OUTPUT CURRENT IN A LINE-POWERED LED DRIVER

(75) Inventors: Thomas Stamm, Chicago, IL (US); Jianwen Shao, Hoffman Estates, IL (US)

(73) Assignee: STMicroelectronics, Inc., Coppell, TX (US)

( * ) Notice: Subject to any disclaimer, the term of this patent is extended or adjusted under 35 U.S.C. 154(b) by 261 days.

(21) Appl. No.: 13/280,126

(22) Filed: Oct. 24, 2011

(65) Prior Publication Data

US 2012/0098463 A1 Apr. 26, 2012

Related U.S. Application Data

(60) Provisional application No. 61/405,697, filed on Oct. 22, 2010.

(51) Int. Cl.
*G05F 1/00* (2006.01)

(52) U.S. Cl.
USPC ..... 315/291

(58) Field of Classification Search
USPC ..... 315/291, 307, 224, 308, 247
See application file for complete search history.

(56) References Cited

U.S. PATENT DOCUMENTS 5,424,933 A * 6/1995 Illingworth ..... 363/21.02
6,362,575 B1 * 3/2002 Chang et al. ..... 315/224
7,781,982 B2 * 8/2010 Tatsumi ..... 315/291
2008/0191685 A1 * 8/2008 Dhuyvetter et al. ..... 324/118
2008/0192509 A1 * 8/2008 Dhuyvetter et al. ..... 363/17
2009/0122580 A1 5/2009 Stamm et al.
2010/0164404 A1 * 7/2010 Shao et al. ..... 315/297
2010/0244726 A1 * 9/2010 Melanson ..... 315/291

OTHER PUBLICATIONS

Datasheet, Version 1.0, ICL8001G, Single-Stage Flyback and PFC Controller for LED Lighting Applications, Industrial & Multimarket, Infineon, May 6, 2010, 16 pgs.
LinkSwitch-PH Family, LNK403-409EG, LED Driver IC with TRIAC Dimming, Single-Stage PFC and Primary-Side Constant Current Control, Power Integrations, Jun. 2010, 20 pgs.
Shao, Jianwen, Single Stage Offline LED Driver, APEC Paper, STMicroelectronics, 2009, 5 pgs.
Transition-Mode PFC Controller, L6562A, STMicroelectronics, Mar. 2007, 20 pgs.
Low-Cost LED Driver for an A19 Lamp, AN3256 Application Note, STMicroelectronics, Sep. 2010, 23 pgs.
A 93% Efficient LED Driver Solution for the US Market, AN3410 Application Note, STMicroelectronics, Sep. 2011, 28 pgs.
Design Equations of High-Power-Factor Flyback Converters Based on the L6561, AN1059 Application Note, STMicroelectronics, Mar. 2000, 20 pgs.
10 Pin Transition-Mode PFC Controller, L6564, STMicroelectronics, Sep. 2009, 34 pgs.
Power Factor Corrector, L6561, STMicroelectronics, Jan. 2003, 12 pgs.

* cited by examiner

*Primary Examiner* — Minh D A
(74) *Attorney, Agent, or Firm* — Gardere Wynne Sewell LLP

(57) ABSTRACT

A line-powered LED driver is operable to provide primary-side regulation of output current supplied to LED circuitry. The circuit includes a feedback loop coupled to a power converter, wherein the feedback loop adds scaled input current to scaled input voltage to produce a control signal. The power converter is responsive to the control signal to adjust input current drawn by the power converter in response to changes in line voltage to provide constant input power. The power converter produces output power for supplying constant output current at the LEDs. The feedback loop may use a reference voltage derived from the LED circuitry so that the output power may be regulated to provide constant LED current for varying LED voltages. When compared to secondary-side current feedback schemes, the LED driver provides increased efficiency and reliability at a reduced cost by implementing primary-side regulation of the output current.

20 Claims, 10 Drawing Sheets

PRIMARY-SIDE REGULATION OF OUTPUT CURRENT IN A LINE-POWERED LED DRIVER

CROSS-REFERENCE TO RELATED APPLICATION

Pursuant to 35 U.S.C. §119(e), this application claims priority to U.S. Provisional Patent Application Ser. No. 61/405,697, entitled "Primary-Side Regulation of Output Current in a Line-Powered LED Driver," filed Oct. 22, 2010, the disclosure of which is hereby incorporated by reference.

BACKGROUND

A line-powered LED driver designed for AC mains applications typically consists of a constant-current power supply, which incorporates power factor correction on the primary side of an isolation transformer, and a current feedback circuit on the secondary side of the isolation transformer. The secondary-side current feedback scheme requires an additional isolated power supply which, in some cases, may be derived from the LED voltage. However, if the LED voltage is not in a usable range, other components are added to the circuit. Additionally, the secondary-side current feedback scheme utilizes an isolated feedback device such as, for example, an optoisolator or transformer. Not only does the isolated feedback device add to the overall cost of the circuit and reduce the available space, the device itself requires additional power, which further reduces circuit efficiency. Accordingly, the number and types of components required to implement the secondary-side current feedback scheme compromise reliability and reduce efficiency of the LED driver.

SUMMARY

The present disclosure provides a line-powered LED driver operable to provide primary-side regulation of output current. In one embodiment, the LED driver comprises: a controller operable to receive an input voltage and an input current, and produce a constant output current for driving LED circuitry; and a feedback network operable to produce a control signal, wherein in response to said control signal, said controller is operable to adjust said input current to maintain a constant input power at said controller; wherein said control signal is the sum of scaled input voltage and scaled input current received at the feedback network; and wherein said controller and said feedback network are implemented on a primary side of a transformer and said output current and LED circuitry are implemented on a secondary side of said transformer.

Also disclosed is a method for providing primary-side regulation of output current in LED driving circuitry, the method comprising: adding a scaled input voltage and scaled input current to produce a first signal; comparing the first signal to a reference voltage to produce a control signal; receiving said control signal at a controller; adjusting an input current received at said controller in response to said control signal to produce a constant input power at said controller; and producing a constant output current for driving LED circuitry; wherein said controller is implemented on a primary side of a transformer and said output current and LED circuitry are implemented on a secondary side of said transformer.

The foregoing and other features and advantages of the present disclosure will become further apparent from the following detailed description of the embodiments, read in conjunction with the accompanying drawings. The detailed description and drawings are merely illustrative of the disclosure, rather than limiting the scope of the invention as defined by the appended claims and equivalents thereof.

BRIEF DESCRIPTION OF THE DRAWINGS

Embodiments are illustrated by way of example in the accompanying figures not necessarily drawn to scale, in which like reference numbers indicate similar parts, and in which.

DETAILED DESCRIPTION OF THE DRAWINGS

Many line-powered LED drivers operate over a narrow range of line voltage, wherein the range of line voltage (i.e., AC mains) is typically limited to either 120V or 230V with a tolerance of about +/−10-15%. In applications utilizing one of these voltage ranges, such as, for example, incandescent light bulb replacement, a secondary-side current feedback scheme may be replaced with a primary-side current regulation scheme. Accordingly, the present disclosure provides a line-powered LED driver operable to provide primary-side regulation of output current. Since the disclosed LED driver implements primary-side regulation, it eliminates the need for the additional components typically required for secondary-side current feedback schemes. Therefore, when compared to secondary-side current feedback schemes, the disclosed LED driver circuitry provides increased efficiency and reliability at a reduced cost by implementing primary-side regulation of the output current.

Although LEDs typically have a wide range of voltage drop, light output is generally specified at a particular current.

If the load voltage is known, then the input power may be adjusted to provide a constant LED current over a range of both line voltage and LED (load) voltage.

Figure 1A:
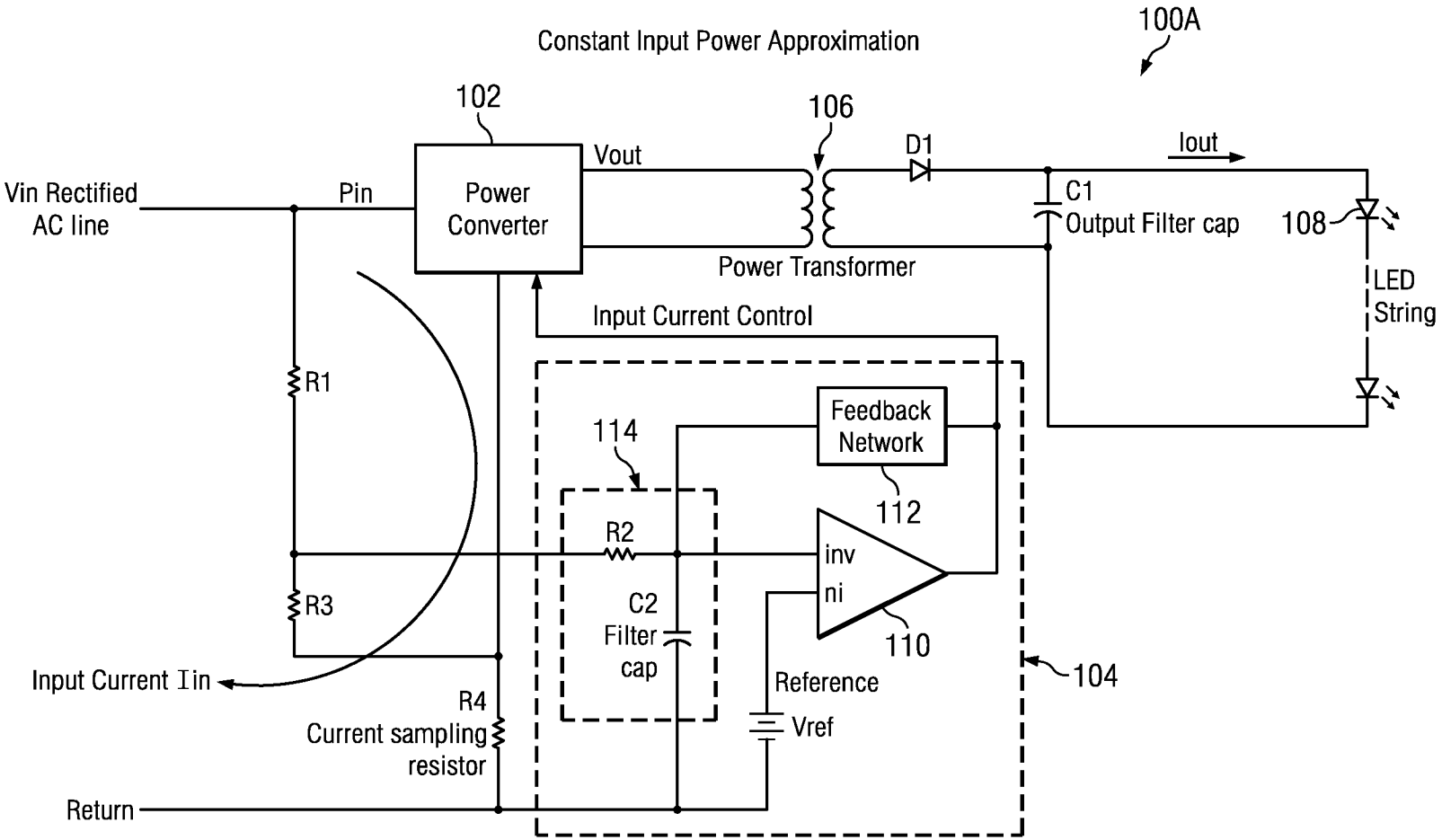
FIG. 1A illustrates an embodiment of the disclosed LED driver incorporating a feedback loop to obtain constant input power.
Figure 1B:
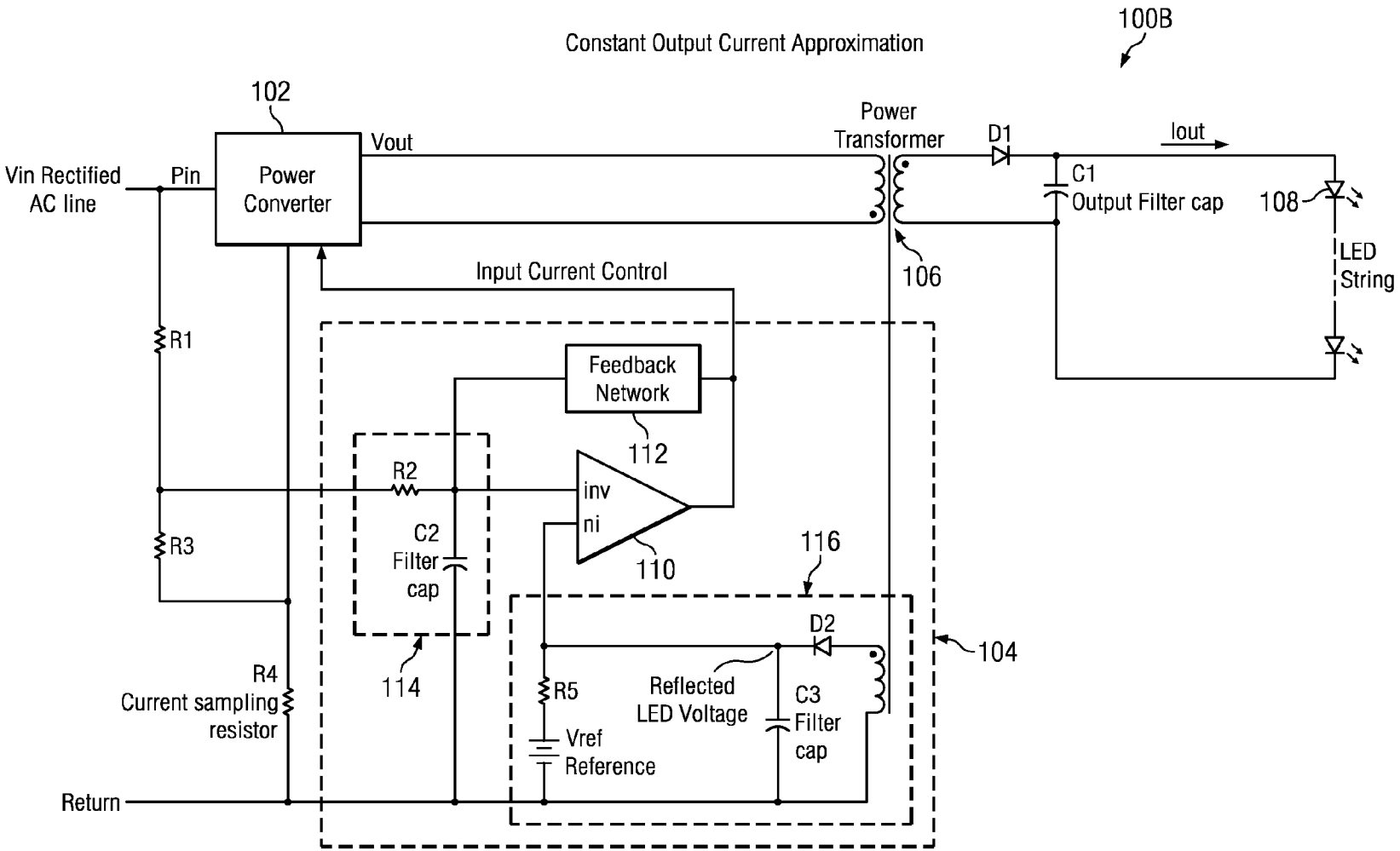
FIG. 1B illustrates an embodiment of the disclosed LED driver incorporating a feedback loop to obtain constant input power adjusted for output voltage, thereby obtaining constant current output.

FIGS. 1A and 1B illustrate example embodiments of LED driver circuits 100A and 100B in accordance with the present disclosure, wherein the LED driver circuits 100A and 100B provide primary-side regulation of the output current. The embodiments illustrated in FIGS. 1A and 1B are described in greater detail below, but generally comprise a power converter circuit 102, constant-power feedback loop 104, power transformer 106, and output LEDs 108. The power converter circuit 102 draws a constant input power Pin from the rectified AC line due to constant-power feedback loop 104, and operates to regulate the output current Iout to provide constant output power at the LEDs 108. It should be appreciated that, in some embodiments, the power converter circuit 102 may be a power factor correction (PFC) circuit known in the art such as, for example, the L6564 or L6562A PFC controllers produced by STMicroelectronics.

The power converter circuit 102 has a stable efficiency that is known over a wide range of conditions such that the output power of the disclosed LED driver circuits 100A and 100B may be regulated by regulating the input power Pin. In some embodiments, the input power Pin may be regulated to achieve a constant input power by adjusting the input current in response to a varying line voltage. This also provides control of the output power.

The input current at the power converter circuit 102 may be calculated in accordance with the following equation:

$$I\text{in}=I\text{out desired}*V\text{out}/(V\text{in}*\eta),$$

wherein Iin is the input current, Iout is the output current (also referred to herein as load current), Vout is the output voltage (also referred to herein as LED voltage or load voltage), Vin is the input voltage (also referred to herein as line voltage), and $\eta$ is converter efficiency. It should be appreciated that although the output voltage Vout is the only variable unique to the secondary side of the transformer 106, it may be derived from existing windings on the primary side. In some embodiments, if the output voltage is known, the input power may be adjusted to achieve constant output current. Accordingly, the above equation is used herein to achieve primary-side regulation of the output current over a range of both line voltage and LED load voltage.

Analog multipliers and dividers utilized in connection with the above equation are both costly and inaccurate. Additionally, when using the analog multipliers and dividers, a current set-point may not be maintained from unit-to-unit within required tolerances. To address these issues, the constant-power feedback loop 104 provided in the embodiments illustrated in FIGS. 1A and 1B utilizes linear approximations of the multiplication and division operations provided in the above equation to satisfy the equation and regulate the output current Iout for a range of line voltage Vin. A linear approximation of the input power Pin is illustrated in FIG. 2 and further described below.

Figure 2:
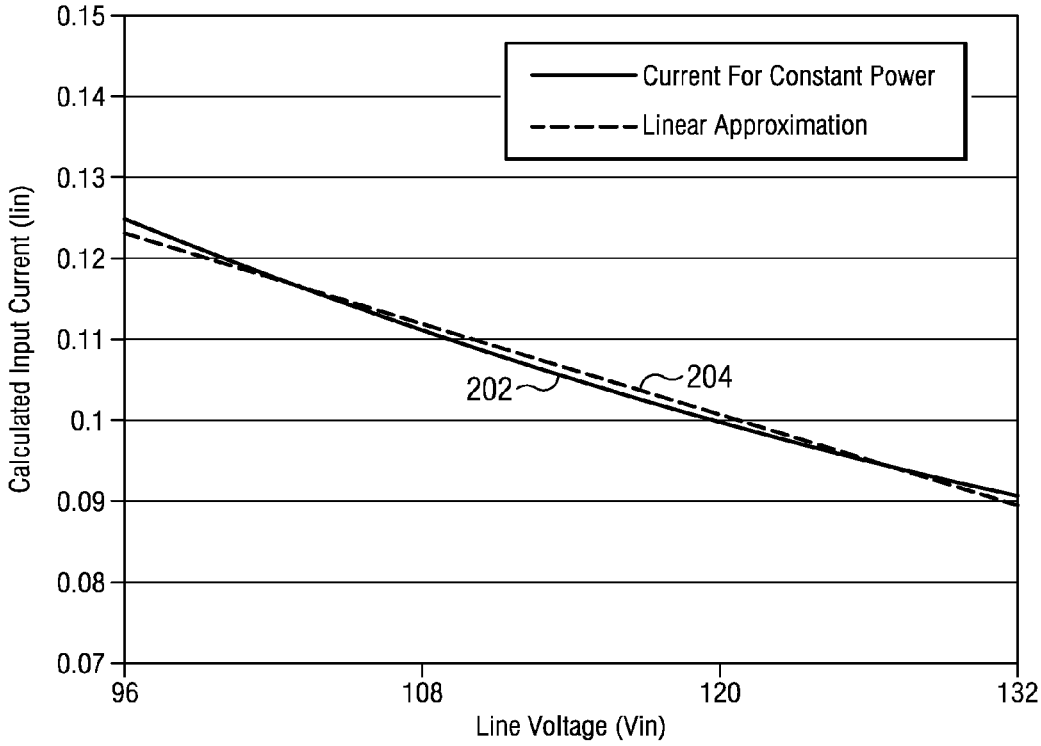
FIG. 2 illustrates a graph of a linear approximation of a constant-power curve for input power provided to power converter circuitry in the embodiments in FIGS. 1A and 1B.

FIG. 2 provides a graph of line voltage Vin and input current Iin for a given input power. Illustrated in FIG. 2 is a constant power curve 202 and its linear approximation 204. The input voltage Vin represented in FIG. 2 shows a typical range requirement, namely, 96V to 132V. In accordance with an embodiment of the present disclosure, the linear power curve approximation 204 is the sum of the scaled line voltage Vin and scaled input current Iin. As such, the multiplication operations typically required to calculate input power are replaced by a sum operation. Therefore, the input power Pin can be regulated by regulating the sum of scaled input voltage Vin and scaled input current Iin over a narrow input voltage range such as, for example, that provided in FIG. 2. Thus, as the input voltage Vin varies, the input current Iin compensates (and vice versa) such that the power converter circuit 102 draws constant input power Pin. The linear power curve approximation 204 is reasonably accurate over the range of line voltage shown in accordance with the degree of error accepted by the lighting industry, as explained in greater detail below with reference to FIG. 3.

Figure 3:
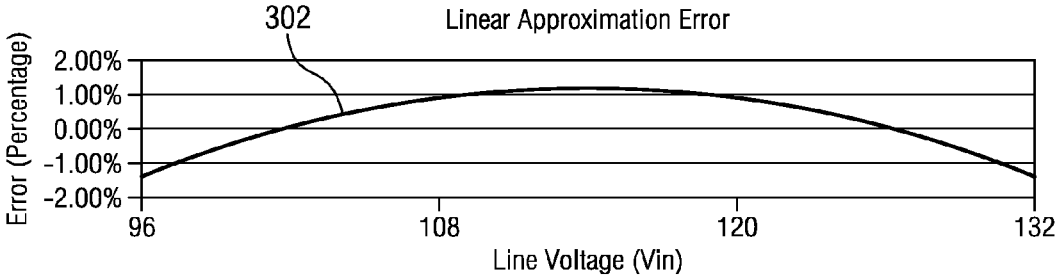
FIG. 3 illustrates the error between the constant-power curve and the linear approximation of the constant-power curve shown in FIG. 2.

FIG. 3 illustrates the error 302 between the constant power curve 202 and the linear approximation 204 shown in FIG. 2. Typically, light output, and thus the error 302, should vary by less than 5% over the line voltage range. In accordance with the error 302 shown in FIG. 3, the linear approximation 204 in FIG. 2 varies by approximately 2.5%. Thus, the degree of error between the constant power curve 202 and the linear approximation 204 is generally accepted as satisfactory by the lighting industry. Therefore, the linear approximation 204 is sufficiently accurate for the voltage range provided in FIG. 2.

Referring specifically to the LED driver circuit 100A shown in FIG. 1A, the circuit 100A is designed to draw constant power Pin from the input line, thereby delivering constant power to the LEDs 108. As shown in FIG. 1A, the constant-power feedback loop 104 comprises an operational amplifier 110, a feedback network 112, and a low-pass filter 114. The output of the operational amplifier 110 controls the current drawn by the power converter 102.

As such, the feedback loop 104 is used to provide an input current control signal to control the power converter circuit 102 to draw a constant input power Pin.

The constant-power feedback loop 104 measures the input power Pin by adding scaled input current Iin to scaled input voltage Vin. In the embodiment illustrated in FIG. 1A, the operational amplifier 110 uses a fixed voltage Vref as a reference to set the input current control signal provided to the power converter 102. The power converter 102 adjusts the drawn input current Iin in response to the input current control signal to provide a constant input power Pin at the power converter 102 responsive to variations in the input voltage Vin. Thus, the constant-power feedback loop 104 illustrated in FIG. 1A is designed to produce the linear power curve approximation 204 shown in FIG. 2.

Referring now to the LED driver circuit 100B shown in FIG. 1B, the constant-power feedback loop 104 of FIG. 1A is modified to add correction of the input power Pin for an LED voltage so as to maintain constant LED current for different LED voltages. Specifically, the constant-power feedback loop 104 is modified to incorporate reference circuitry 116 operable to add the LED voltage representation to the fixed voltage reference Vref provided to operational amplifier 110.

The LED driver circuit 100B illustrated in FIG. 1B is designed to maintain a constant output current Iout at the LEDs 108 by adjusting the output power provided to the LEDs 108 to correspond directly to a change in the load voltage. As previously mentioned, the output power may be regulated by adjusting the input power Pin provided to the power converter 102. Since the line voltage Vin provided to the constant-power feedback loop 104 is given, the input power Pin may be adjusted by adjusting the input current Iin drawn by the power converter circuit 102. Adjustment of the input current Iin drawn by the power converter 102 may be achieved by adjusting the control input provided to the power converter circuit 102 from the operational amplifier 110. Thus, by using the representation of the LED voltage as part of a reference voltage to the operational amplifier 110, the input current Iin, and thus, the input power Pin may be controlled to adjust the output power provided to the LEDs 108 in response to variations of the load voltage, so that a constant output current Iout is maintained at the LEDs 108.

Figure 4:
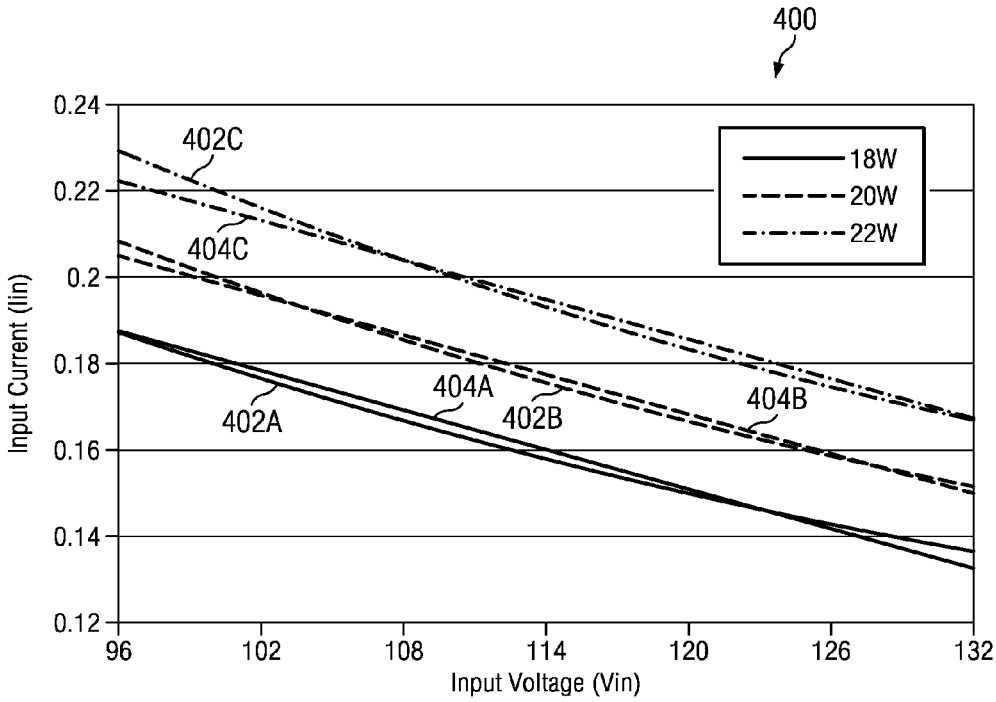
FIG. 4 illustrates a graph of three example constant power curves for respective output power levels of 18W, 20W, and 22W and their corresponding linear approximations in accordance with the embodiment of the LED driver illustrated in FIG. 1B.

In the embodiment illustrated in FIG. 1B, the reflected LED voltage on C3 may be used for calculating adjustments to the input current Iin for a varying load voltage, wherein the output power is determined for a narrow range of line voltage Vin as discussed with reference to FIG. 4. The graph 400 in FIG. 4 illustrates three example constant power curves 402A-402C for respective output power levels of 18W, 20W, and 22W and the corresponding linear approximations 404A-404C for each of the respective constant power curves 402A-402C. The three levels of output power shown in FIG. 4 correspond to LED voltages of 10% below nominal (18W), nominal (20W), and 10% above nominal (22W). The input voltage Vin represented in FIG. 4 includes a typical line voltage range, namely, 96V to 132V. As explained above in accordance with the LED driver circuit 100B illustrated in FIG. 1B, the linear power curve approximations 404A-404C illustrated in FIG. 4 are the sum of the scaled input voltage and current and a voltage representing the scaled output voltage of the LEDs 108.

Figure 5:
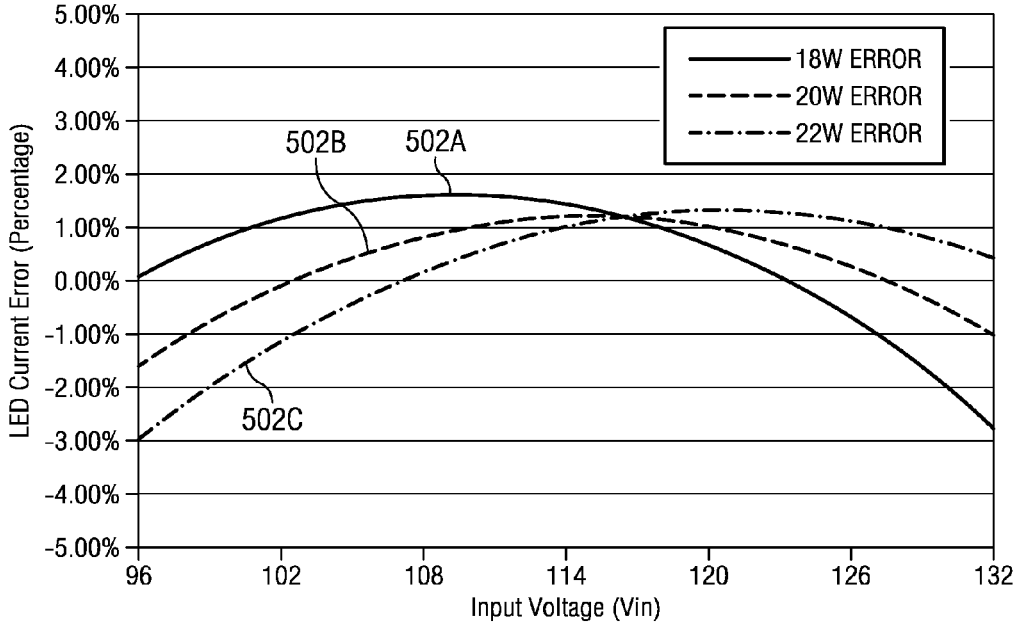
FIG. 5 illustrates the error between the respective constant power curves and linear approximations shown in FIG. 4.

FIG. 5 illustrates the error 502A-502C between the respective constant power curves 402A-402C and linear approximations 404A-404C shown in FIG. 4. In accordance with the embodiment illustrated in FIG. 1B, if the line voltage (Vin) remains at design center (e.g., approximately 116V), the input current responds accurately to the load voltage (see line 502B). However, if the line voltage Vin differs from design center, the output current will vary in response as a function of both load voltage and line voltage. This variation of the output current is represented by lines 502A and 502C in FIG. 5, wherein over a range of line voltage (e.g., 120V +10%, −20%) and LED voltage (+/−10%), the variation of LED current is less than 4.5%. Although the output current may vary as the line voltage differs from design center, the error remains relatively small and, therefore, is satisfactory for the voltage range. Accordingly, the disclosed LED driver circuit 100B illustrated in FIG. 1B provides sufficiently accurate output current Iout for a range of load voltages, even when the line voltage Vin fluctuates from design center.

It should be appreciated that variations of the embodiments illustrated in FIGS. 1A and 1B may be made without departing from the scope of the present disclosure as set forth in the claims below. For example, since the waveform of the AC line voltage is approximately a sine wave, and the AC line current is programmed to follow the same waveform, any known relationships between average, RMS and peak voltage may be exploited as further explained below.

In some embodiments, average input current Iin and average input voltage Vin may be used for providing constant input power Pin. For example, in one embodiment, a voltage representing the input current may be available by simply placing a resistor in the input path. Accordingly, this voltage can be directly added to the average input voltage through a simple divider, and the resulting sum filtered as the approximate input power.

In most power converter topologies, the vast majority of the input current flows through the switching device. Usually a resistor is already in place to monitor the current in the switch. The voltage across the resistor, when the switching waveform and twice-line-frequency components are filtered out, is the average input current.

As alluded to above, since the average input voltage and current waveforms are both relatively sinusoidal, a known relationship exists between the average and RMS voltages. As such, the power approximation obtained by adding the two can be used as a representation of input power. When heavily filtered, a DC level may be obtained.

In other embodiments, peak input voltage Vin and/or peak input current Iin may be used for providing constant input power Pin. For example, for a dimming application using leading-edge phase control (common triac), or trailing-edge cutoff, it may be desirable to measure the peak voltage rather than the average voltage. At the maximum setting, most phase control dimmers cut off one end of the input sine wave, reducing the average voltage. If the average-responding scheme described above is used, the output current may be higher with the dimmer on full than if a dimmer were not in the line. This problem can be solved by sampling only the peak line voltage and adjusting the percentage added to the current measurement. In some embodiments, measurements of peak voltages and currents may be taken from simple sample-and-hold circuits. Similarly, either the filtered line current peak or the peak current in the power converter stage can be sampled and scaled. It should be appreciated that any method of measuring input voltage or current can be used.

FIGS. 6-10 illustrate example circuit schematics for various embodiments of the LED driver circuitry described herein in accordance with the present disclosure. Each of the various example schematics are further described below with reference to respective FIGS. 6-10.

Figure 6:
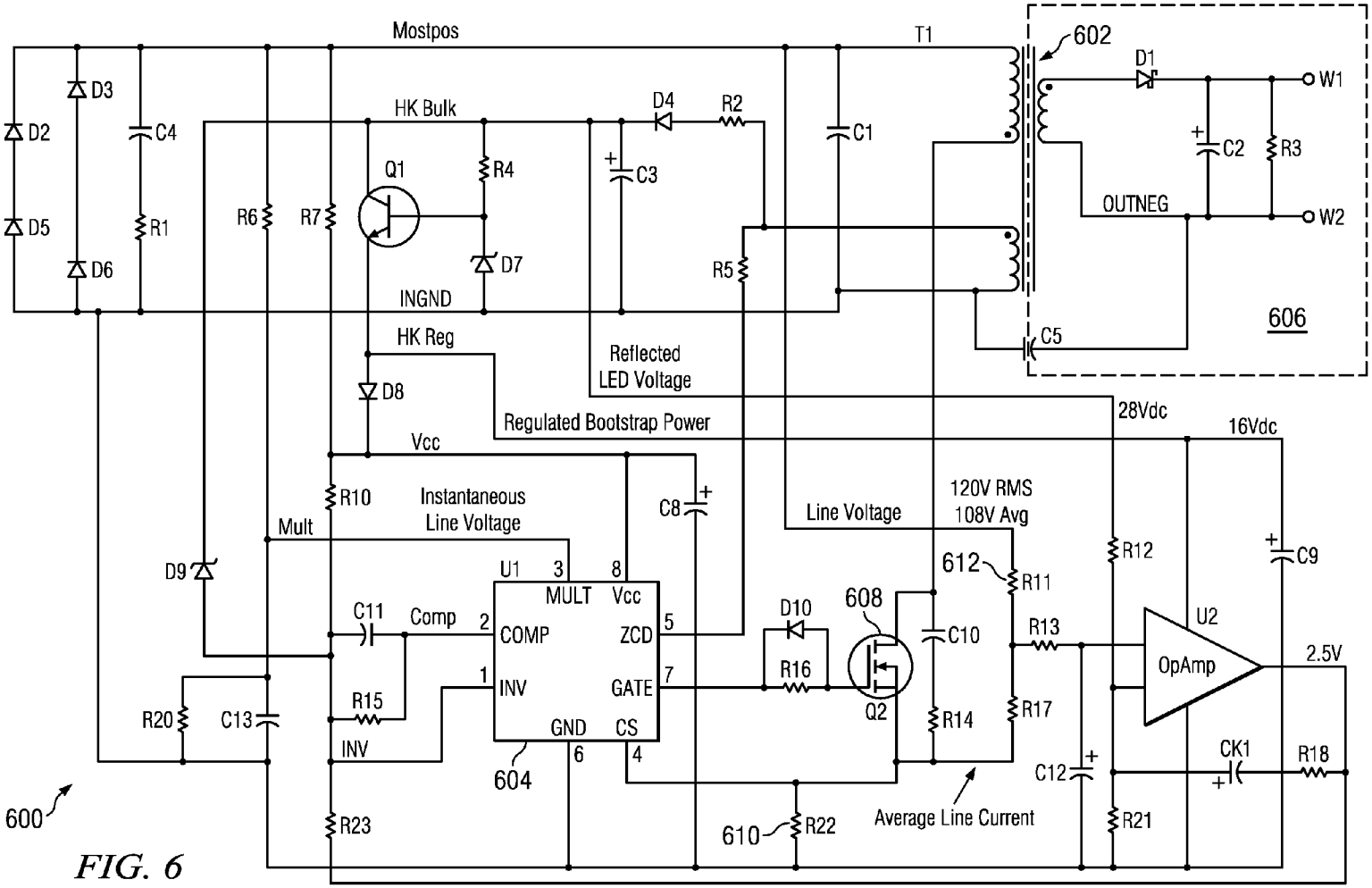
FIG. 6 illustrates an example circuit schematic of an embodiment of the disclosed LED driver using average line detection as line voltage input.

FIG. 6 illustrates an example circuit schematic 600 of an embodiment of the disclosed LED driver using average line detection as line voltage input. The example circuit 600 may be implemented in a line-powered LED driver. In the embodiment illustrated in FIG. 6, an isolation transformer 602 is used to make the LEDs and their heatsink "touch-safe" while maintaining good thermal contact between them. The circuit 600 shown in FIG. 6 uses the STMicroelectronics L6562A as a controller 604 (see ST L6562A datasheet entitled "Transition-Mode PFC Controller," incorporated herein by reference), though other controller devices could be used (such as the STMicroelectronics L6561, see ST L6561 datasheet entitled "Power Factor Corrector," incorporated herein by reference). The power converter shown in FIG. 6 has a PFC-Flyback topology, though other topologies could be used (such as step-down, see FIGS. 8A and 8B herein). Note that there is no galvanic connection between the circuitry 606 on the secondary side of the transformer 602 and the AC line connected components on the primary side.

In FIG. 6, the input current is taken from the current through the FET 608. The controller 604 regulates the FET's peak current in response to the voltage on pin 2 of the controller 604. The L6562A's internal multiplier is used to force the peak FET current to track the rectified line voltage (presented to pin 3).

Figure 7:
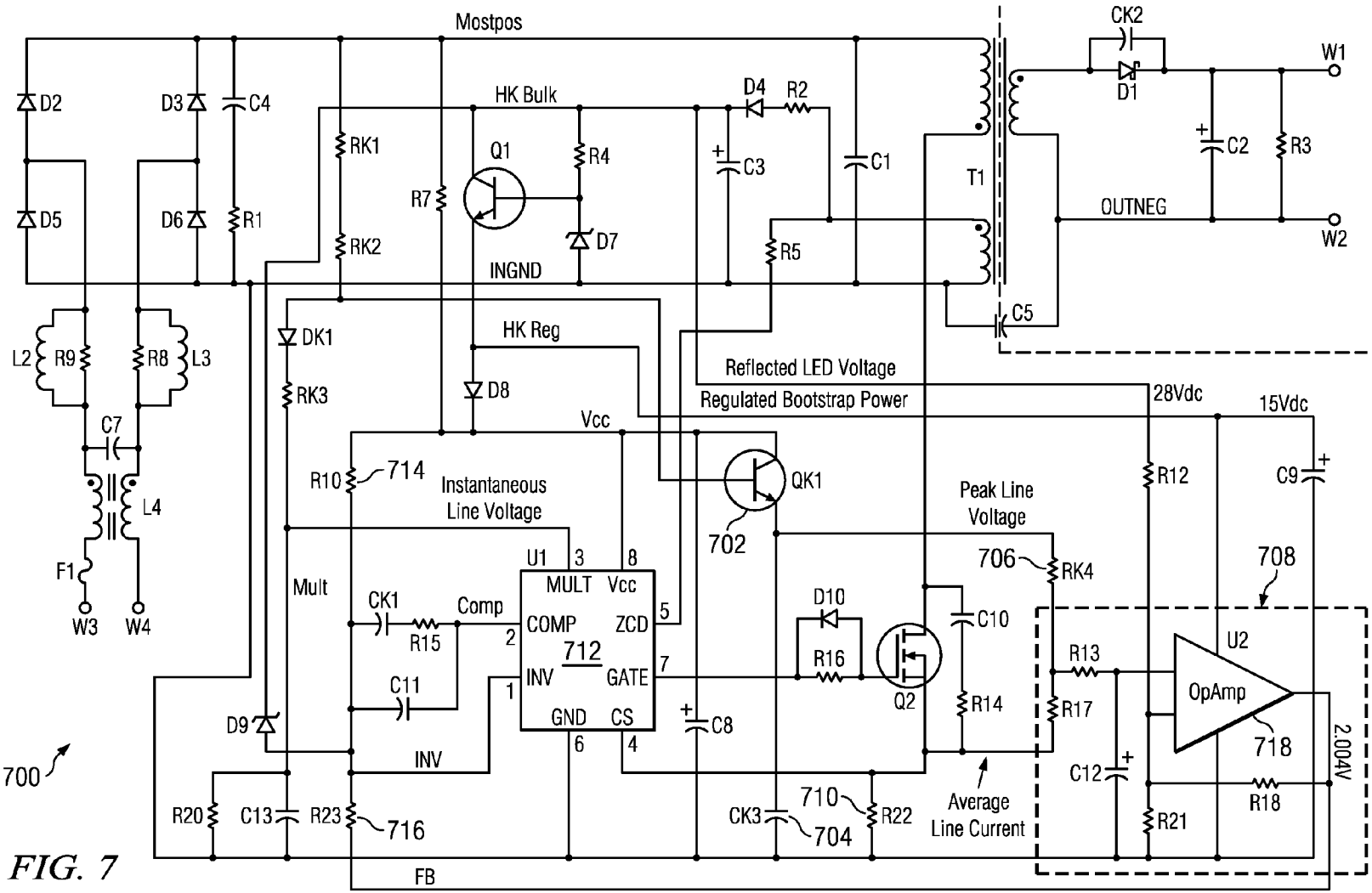
FIG. 7 illustrates an example circuit schematic of an embodiment of the disclosed LED driver using peak line detection as line voltage input.

FIG. 7 illustrates an example circuit schematic 700 of an LED driver design using peak line detection as line voltage input. This circuit 700 may be implemented by modifying the circuit shown in FIG. 6 to use the peak line voltage as an input.

In the circuit 700 illustrated in FIG. 7, the aforementioned peak sample-and-hold function is performed by QK1 (see 702), which charges capacitor CK3 (see 704) to a known fraction of the peak line voltage. Resistor RK4 (see 706) feeds the voltage into the calculation circuitry 708.

Referring briefly to both FIGS. 6 and 7, it should be appreciated that other schemes may be realized in connection with the embodiments illustrated in FIGS. 6 and 7. For example, in the circuit 600 in FIG. 6, the peak current through resistor R22 (see 610) could be sampled, held, and then combined with the average voltage delivered through resistor R11 (see 612) as explained above. Similarly, in the circuit 700 in FIG. 7, the peak current through resistor R22 (see 710) could be sampled, held, and then combined with the peak-sample-and hold voltage provided by the circuit 700 as explained above.

The circuit 700 illustrated in FIG. 7 also shows a method for obtaining a current reference from the L6562A controller 712, which does not expose its precise 2.5V internal reference on a pin. The L6562A's internal opamp is connected as an integrator, with no resistor between the output and the input. In steady state, the internal opamp's inverting input will receive no current from the opamp output. If the control loop is in balance, both inputs of the L6562's internal opamp should be at the same voltage. Since the control loop seeks balance, and since there is no DC path from the output to the inverting input, the inverting input can be used as a reference voltage. For a controller 712 comprising the L6561, L6562, or similar parts, this means that the output of the external opamp will be at exactly 2.5 volts in steady state.

In FIGS. 6 and 7, the L6562A requires a minimum voltage on pin 1 to start (pin 1 will inhibit the chip if it falls below about ½ volt). Therefore, any current injected into pin 1 by a biasing network (R10 from Vcc—see 714) must be balanced by current through resistor R23 (see 716) from the output of the operational amplifier U2 (see 718), thereby shifting the voltage at the operational amplifier U2 output to about 2.004V with the values shown in FIG. 7.

Once the voltage at the output of the operational amplifier U2 (see 718) has shifted, the circuit 700 is sensitive to changes in the housekeeping voltage supplying the current injected into pin 1 of the controller 712. However, since the shift of voltage on U2's output is only about ⅕ of the reference voltage, the effect of the housekeeping voltage tolerance is only about ⅕ of the total. With a 5% housekeeping voltage tolerance and 1% tolerance on resistor R10 (again, see 714), the shift of U2's output voltage varies by about 1.2%, which is satisfactory for many lighting applications.

It should be appreciated that although a different and, perhaps, more precise scheme using diode isolation could have been used at pin 1 to start the L6562A controller 712, such a scheme would require more parts, and thus, is not acceptable in lighting applications where space is at a premium.

Figure 8A:
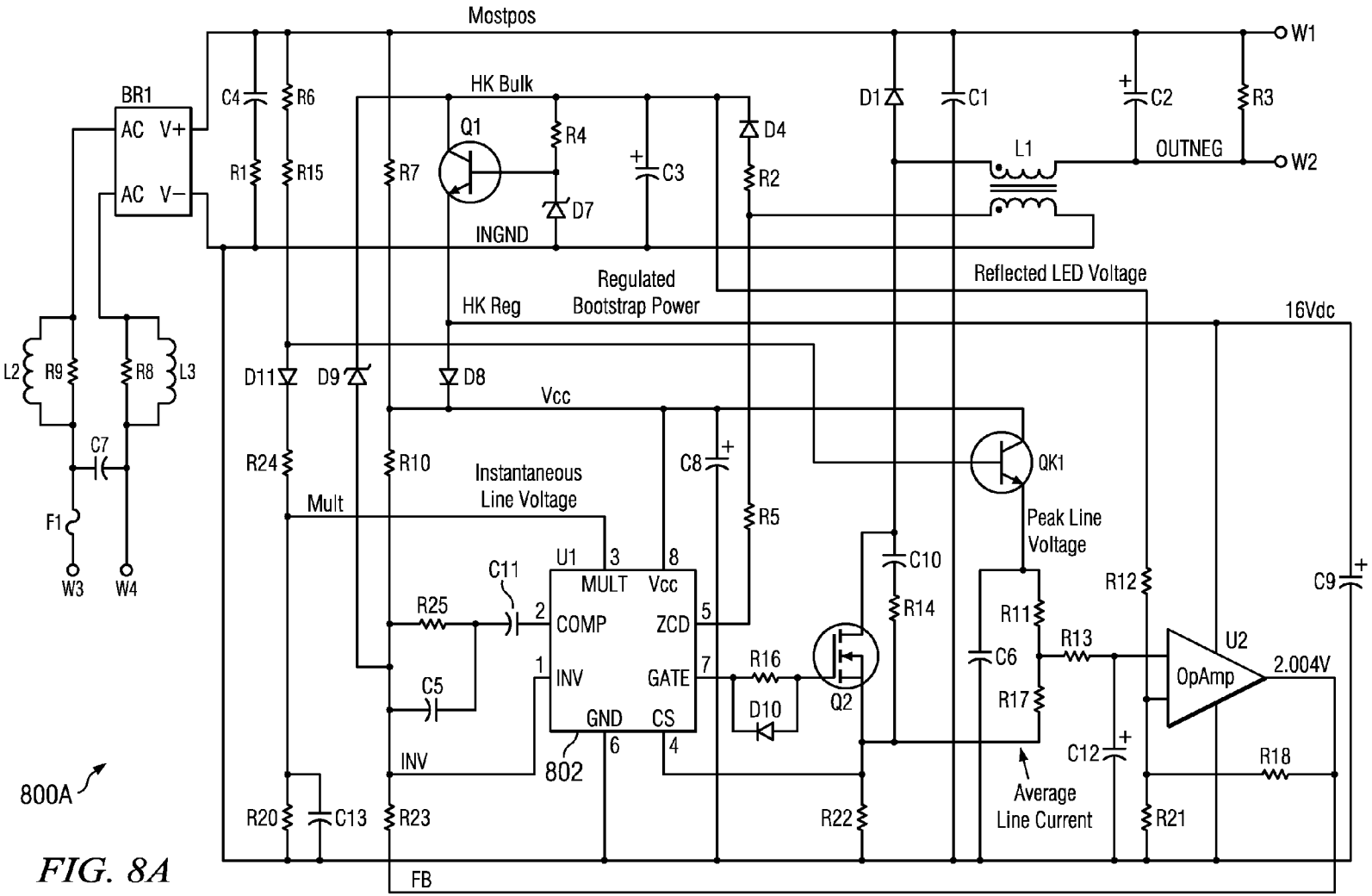
FIGS. 8A and 8B illustrate example circuit schematics of a step-down configuration circuit of a dimmable, non-isolated embodiment of the disclosed LED driver.
Figure 8B:
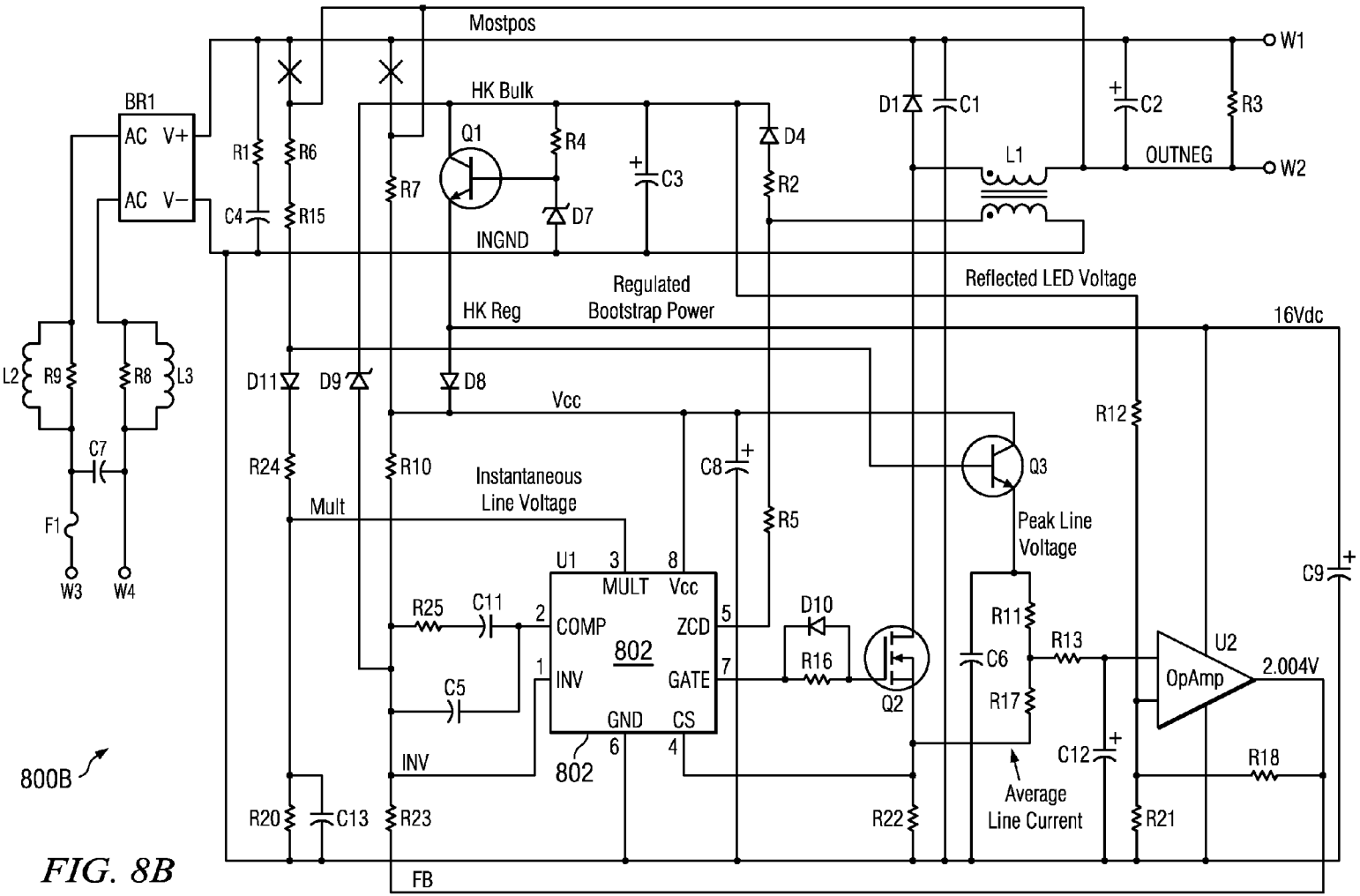

FIGS. 8A and 8B provide circuit schematics 800A and 800B of a dimmable, non-isolated LED driver. The coupled inductor has a 1:1 low current winding to power the L6562A PFC driver 802. Since measuring LED current directly is impractical, the unit uses "primary regulation" to compensate for varying line and LED voltages.

FIGS. 8A and 8B show two possible implementations for obtaining a reference waveform. A first option is illustrated in FIG. 8A, wherein the reference waveform is obtained from the line Mostpos (this is also indicated in FIG. 8B through the circuit connections marked "X" and with no connection to OUTNEG). Another option, shown in FIG. 8B, is to obtain the reference waveform from the line OUTNEG (as indicated by the connection to OUTNEG and the cutting of the circuit connections marked "X", wherein this schematic is specifically shown in FIG. 8B). The second option of FIG. 8B may be preferred as it may produce a higher power factor.

Figure 9:
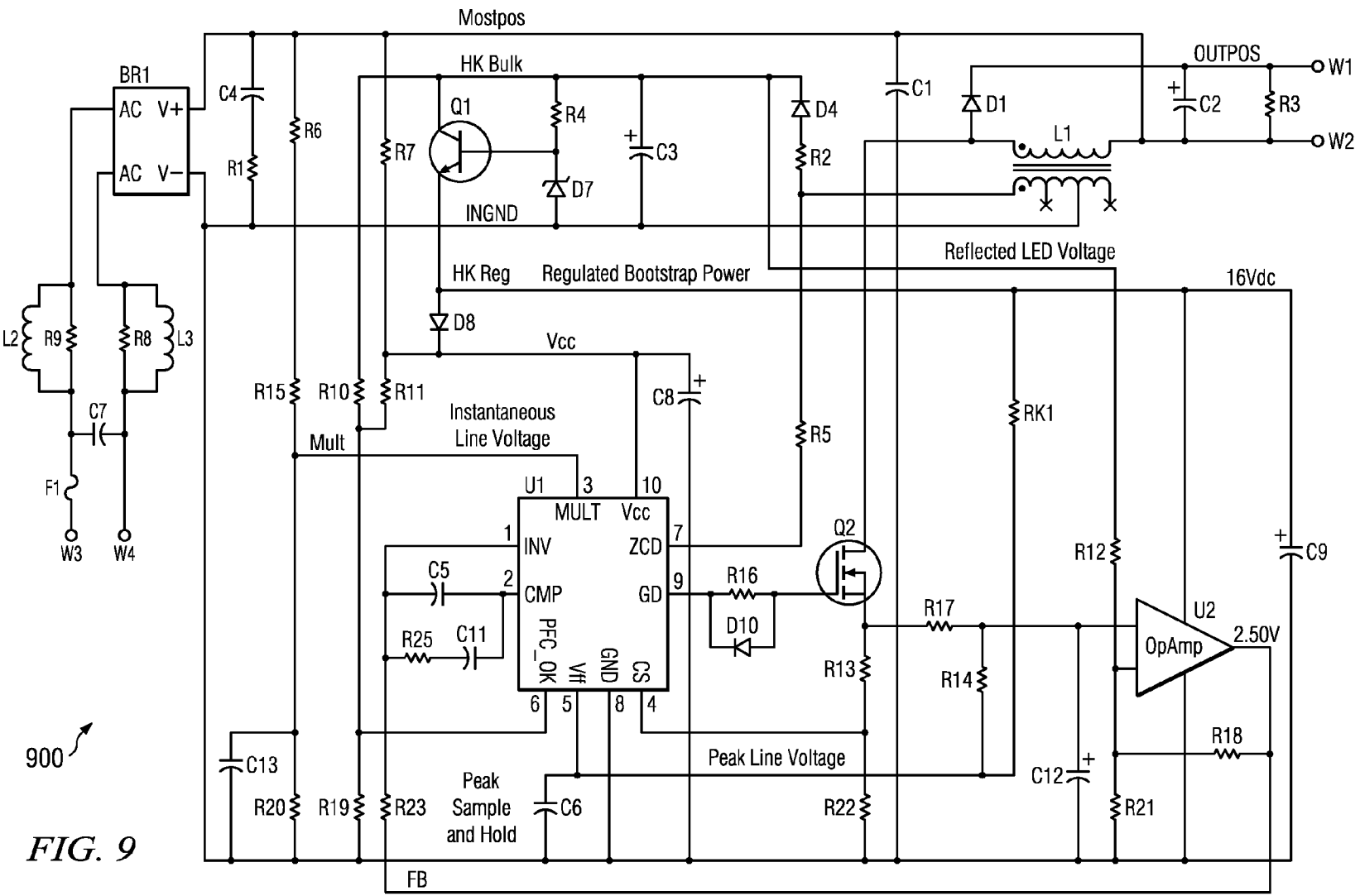
FIG. 9 illustrates an example circuit schematic of a dimmable, non-isolated embodiment of the disclosed LED driver.

With respect to operation of the circuitry of FIGS. 6, 7, 8A, and 8B, specific attention is directed to the feedback control circuitry in the bottom right hand corner of the schematics. A description of this circuitry and its operation is provided below in connection with the description of FIG. 9. FIGS. 6, 7, and 9 illustrate a fly-back configuration circuit, while FIGS. 8A and 8B illustrate a step-down configuration circuit. The feedback control circuitry is useful in either circuit configuration.

FIG. 9 illustrates an example circuit schematic 900 of a dimmable, non-isolated embodiment of the disclosed LED driver, in accordance with the present disclosure. The circuit 900 utilizes ST's L6564 power factor controller to regulate the input power to a non-isolated flyback switching regulator (see ST L6564 datasheet entitled "10 Pin Transition-Mode PFC Controller," incorporated herein by reference). The circuit 900 compensates for different LED voltage drops to maintain the average output current in a tight band over a wide range of line voltage and LED characteristics.

C7, L2, and L3 provide filtering for conducted EMI. Bridge rectifier BR1 feeds the flyback (buck-boost) power converter. L1 is charged by Q2 when it is turned on, and it discharges into the LED load when Q2 turns off.

The circuit 900 starts up with a trickle of current into C8 through R7. It takes about 0.25 seconds to charge C8 to U1's startup voltage of approximately 11V. The startup timer in U1 starts the switching cycle by turning on Q2. Current in Q2 and L1 increases from zero to about 1700 mA at the peaks of the input sine wave. This current appears on R22. Q2 is turned off when the voltage on R22 reaches a calculated level. Current in L1 continues to flow through D1 into C2 and the LED load after Q2 turns off. The current ramps toward zero, at which time D1 turns off. The FET drain voltage then begins to fall.

L1 and stray capacitance then ring the voltage at D1's anode down to about twice the LED voltage below the positive rail. When the ringing voltage turns up, U1 senses the end of L1's discharge and turns on Q2 very close to the minimum ringing voltage, starting the next cycle. Current in L1's upper winding therefore ramps between zero and twice the load current. When Q2 turns on, D1 has already turned off, so Q2 never sees D1's reverse recovery current.

Because the LED driver illustrated in FIG. 9 is dimmable, the range of LED voltages may be relatively large. As such, a voltage regulator may be desired. Housekeeping power is supplied by the auxiliary (lower) winding on L1. The winding is connected through D4 so that the transformed LED voltage (positive) is applied to C3. Q1, R4, and D7 form the voltage regulator, which powers U2 directly and U1 through D8. R2 and C9 form a filter to remove ringing spikes due to leakage inductance.

The auxiliary (lower) winding on L1 has a turns ratio that puts about 30V on C3 with the AC line applied. The voltage on C3 is proportional to the LED voltage, and is used in the LED current regulation scheme as further described below. The auxiliary winding also provides U1 with timing for the zero-current sensing function, through R5.

In an undimmed case, the LED current may be regulated to prevent damage due to high line conditions. Since the human eye adjusts to light level changes over a period of about 0.25 seconds, the regulation circuit makes adjustments slowly so that the light level appears constant.

The control circuit works by controlling average input power. As explained above, it is assumed that the power converter efficiency is constant over the range of line voltage and LED voltage. As such, average output power is also controlled.

In accordance with the present disclosure, analog circuitry is used to sum the average input current and the average input voltage. It should be appreciated that in the description of the circuit 900 in FIG. 9, diode drops, opamp offsets, and bias currents are ignored for purposes of simplicity.

Referring again to the circuit 900 in FIG. 9, the vast majority of current flows through R22, which is the current sense resistor for the PFC-Flyback converter. The average of the current in R22 and the scaled peak of the sinusoidal line voltage are used in the power calculation.

U1 contains a precision peak detector, which places the peak input voltage from divider R6-R15-R20 on its Vff pin, storing the result on C6. In some embodiments, this voltage is used internally by the L6564 controller to adjust its multiplier gain to accommodate a wide line voltage range. Since the input voltage is sinusoidal, a known relationship exists between the peak voltage and the average voltage used in the calculation.

Scaling and addition of voltage and current is done by R17 and R14. The AC noise present at their junction is removed by C12. The DC voltage on C12 now represents the input power as calculated by the linear approximation. This voltage is regulated by the slow PFC feedback loop.

The feedback loop requires only one inversion, supplied by the opamp in U1. Opamp U2 is wired as a non-inverting amplifier, wherein U2 performs three different functions: (i) deriving a reference voltage from U1, (ii) providing gain for the relatively low voltage on C12, and (iii) providing a point in the circuit to compensate for different LED voltages.

A DC reference voltage is derived from U1's inverting input. This point will be at 2.5V if the control loop is in steady state, since there is no DC current path to any other voltage source. In steady state, the current through R23 is zero, so the output pin of U2 should also be at 2.5V. This reference voltage is delivered to U2's inverting input by divider R18-R21. The voltage divider R18-R21 also sets the DC gain for U2. If this circuit acted alone, the input power would be approximately regulated to a fixed value, and the LED current would inversely track the LED voltage.

The control loop is provided to set the average current through R22 to deliver slightly more than the desired LED current when both the line voltage and LED voltage are at design center. Deviations of line and LED voltage from this point will then cause smaller deviations of LED current.

The input current required is Iled×Vled/(Vline×Efficiency). The straight-line approximation of the constant-power curve (as explained above with respect to FIG. 4) should provide equal voltage from the average line voltage and the average input current. The value of R22 may be determined from the usual calculations (see ST Application Note AN1059, reference 1). The average input current in R22 can now be calculated from the design center line voltage, output power, and efficiency. At design center line voltage, LED current, and LED voltage, the average voltage appearing across R17 due to current from R14 should match the average voltage on R22.

The LED voltage (multiplied by L1's turns ratio) is available on C3. Current proportional to this voltage is delivered to U2's inverting input by R12. Now, for purposes of explaining the stirring in of the reference voltage, consider a case in which the LED voltage is zero. Assume the LED current remains at 350 mA, resulting in a required power of zero. U2's output will be at 2.5V, setting its inverting input at the same level as the line voltage component from R14. No current is required from Q2 in this particular case and, thus, input power is zero.

Now, assume the LED voltage rises, with the LED current still at 350 mA. Input current proportional to the LED voltage is now required, so the input power must rise. Since the input voltage is fixed, the average input current must rise proportional to the LED voltage. The circuit 900 will be balanced when the voltage increase at U2's inverting input is matched by a voltage increase due to the average current through R22, the same as the average input current. It should be appreciated that variations to the circuit 900 illustrated in FIG. 9 may be made without departing from the spirit or scope of the present disclosure as set forth in the claims provided below.

Figure 10:
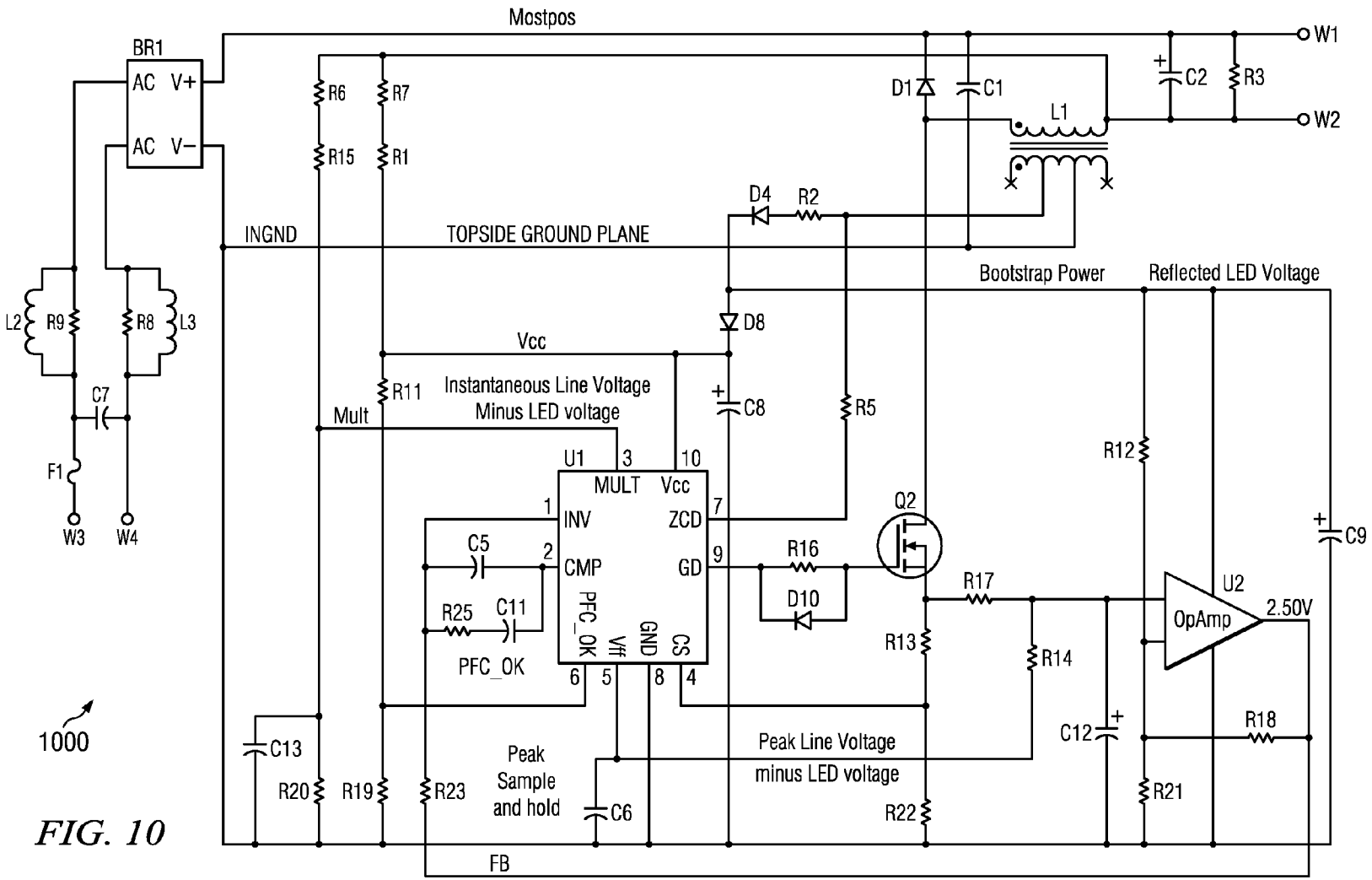
FIG. 10 illustrates an example circuit schematic of a non-dimmable, non-isolated embodiment of the disclosed LED driver.

Referring now to FIG. 10, an example circuit schematic 1000 of a non-dimmable, non-isolated embodiment of an LED driver, is illustrated in accordance with an embodiment of the present disclosure. The circuit 1000 uses line voltage derived from peak voltage at the bottom of the LED string as line voltage input. A sample-and-hold circuit is part of the L6564. Therefore, a voltage proportional to the line peak is available on its pin 5. This voltage is stored on C6 and delivered to the calculation circuitry by R14.

With respect to the various circuit configurations and operations, reference is further made to ST Application Notes AN3256, AN1059, and AN3410, and J. Shao, "Single Stage Offline LED Driver," IEEE 2009, the contents of all of which are incorporated herein by reference.

What is claimed is:

1. A circuit, comprising:

a power converter operable to receive an input voltage and an input current, and including a power transformer configured to produce an output current for driving LED circuitry; and a feedback network operable to produce a control signal for controlling operation of the power converter to adjust said input current so as to maintain a constant input power at said power converter;

wherein said feedback network is operable to generate said control signal from a sum of scaled power converter input voltage and scaled power converter input current; and wherein said power converter and said feedback network are implemented on a primary side of said power transformer and said output current and LED circuitry are implemented on a secondary side of said power transformer.

2. The circuit as set forth in claim 1, wherein producing said control signal comprises comparing said sum of scaled input voltage and scaled input current to a reference.

3. The circuit as set forth in claim 2, wherein said reference is a fixed voltage.

4. The circuit as set forth in claim 2, wherein said reference is comprised of a sum of a fixed voltage and a reflected LED voltage derived from said secondary side of said power transformer.

5. The circuit as set forth in claim 4, wherein said reflected LED voltage is a voltage representing a scaled output voltage of said LED circuitry.

6. The circuit as set forth in claim 4, wherein said input current is adjusted to maintain a constant input power to said power converter in response to a change in said reflected LED voltage.

7. The circuit as set forth in claim 4, wherein said input current is adjusted to maintain said constant output current in response to a change in said reflected LED voltage.

8. The circuit as set forth in claim 1, wherein said input current is adjusted to maintain a constant input power to said power converter in response to a change in said input voltage.

9. The circuit as set forth in claim 1, wherein said power converter is further operable to regulate said input power to produce a regulated output power.

10. The circuit as set forth in claim 9, wherein said input power is regulated by adjusting the input current received at said power converter in response to a change to the input voltage.

11. A method for providing primary-side regulation of output current in LED driving circuitry, the method comprising:

adding a scaled input voltage to a power converter and a scaled input current to said power converter to produce a first signal;

comparing the first signal to a reference to produce a control signal;

receiving said control signal at said power converter;

adjusting an input current received at said power converter in response to said control signal to produce a constant input power at said power converter; and producing an output current for driving LED circuitry;

wherein said power converter is implemented on a primary side of a power transformer and said output current and LED circuitry are implemented on a secondary side of said power transformer.

12. The method as set forth in claim 11, further comprising adjusting said input power in response to a change in an LED voltage to maintain said output current driving said LED circuitry.

13. The method as set forth in claim 11, wherein said reference is a fixed voltage.

14. The method as set forth in claim 11, wherein said reference is comprised of the sum of a fixed voltage and a reflected LED voltage derived from said secondary side of said power transformer.

15. The method as set forth in claim 14, wherein said reflected LED voltage is a voltage representing a scaled output voltage of said LED circuitry.

16. The method as set forth in claim 14, further comprising adjusting said input current to maintain a constant input power to said power converter in response to a change in said reflected LED voltage.

17. The method as set forth in claim 14, further comprising adjusting said input current to maintain said constant output current in response to a change in said reflected LED voltage.

18. The method as set forth in claim 11, further comprising adjusting said input current to maintain said constant input power to said power converter in response to a change in said input voltage.

19. The method as set forth in claim 11, further comprising said power converter regulating said input power to produce a regulated output power.

20. The method as set forth in claim 19, further comprising regulating said input power by adjusting the input current received at said power converter circuit in response to a change to the input voltage.

* * * * *

UNITED STATES PATENT AND TRADEMARK OFFICE

CERTIFICATE OF CORRECTION

PATENT NO. : 8,803,439 B2
APPLICATION NO. : 13/280126
DATED : August 12, 2014
INVENTOR(S) : Thomas Stamm et al.

It is certified that error appears in the above-identified patent and that said Letters Patent is hereby corrected as shown below:

In the Specification:

At column 3, line number 14, please replace the term [lout] with -- Iout --.

At column 3, line number 54, please replace the term [lout] with -- Iout --.

At column 4, line number 53, please replace the term [lout] with -- Iout --.

At column 5, line number 3, please replace the term [lout] with -- Iout --.

At column 5, line number 40, please replace the term [lout] with -- Iout --.

Signed and Sealed this
Fourth Day of November, 2014

Michelle K. Lee

Michelle K. Lee
*Deputy Director of the United States Patent and Trademark Office*